US008758602B2

(12) United States Patent
Yamamoto et al.

(10) Patent No.: US 8,758,602 B2
(45) Date of Patent: Jun. 24, 2014

(54) METHOD AND APPARATUS FOR UPGRADING COAL

(75) Inventors: Seiichi Yamamoto, Takasago (JP); Takuo Shigehisa, Takasago (JP); Satoru Sugita, Takasago (JP); Yuko Sugita, legal representative, Kobe (JP); Yutaka Mitou, Takasago (JP); Shigeru Kinoshita, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 459 days.

(21) Appl. No.: 12/995,010

(22) PCT Filed: May 11, 2009

(86) PCT No.: PCT/JP2009/058766

§ 371 (c)(1),
(2), (4) Date: Nov. 29, 2010

(87) PCT Pub. No.: WO2009/145047

PCT Pub. Date: Dec. 3, 2009

(65) Prior Publication Data

US 2011/0284671 A1 Nov. 24, 2011

(30) Foreign Application Priority Data

May 29, 2008 (JP) ..... 2008-140914

(51) Int. Cl.
*C10G 1/00* (2006.01)
*C10G 1/04* (2006.01)

(52) U.S. Cl.
CPC ..... *C10G 1/045* (2013.01); *C10G 1/04* (2013.01); *C10G 1/00* (2013.01)
USPC ..... 208/400

(58) Field of Classification Search
CPC ..... C10G 1/00; C10G 1/04; C10G 1/042; C10G 1/045
USPC ..... 208/400; 34/389
See application file for complete search history.

(56) References Cited

U.S. PATENT DOCUMENTS 2,323,047 A * 6/1943 Joseph ..... 208/358
4,185,395 A 1/1980 Nakako et al.
5,660,615 A * 8/1997 Neumann et al. ..... 95/187

FOREIGN PATENT DOCUMENTS

CN 1108684 A 9/1995
DE 587 511 11/1933

(Continued)

OTHER PUBLICATIONS

U.S. Appl. No. 13/290,466, filed Nov. 7, 2011, Sugita, et al.
U.S. Appl. No. 13/124,133, filed Apr. 14, 2011, Sugita, et al.
International Search Report issued Jul. 21, 2009 in PCT/JP09/058766 filed May 11, 2009.

(Continued)

*Primary Examiner* — Randy Boyer
*Assistant Examiner* — Brandi M Doyle
(74) *Attorney, Agent, or Firm* — Oblon, Spivak, McClelland, Maier & Neustadt, L.L.P.

(57) ABSTRACT

A method of upgrading coal which comprises: pulverizing low-grade coal; mixing the pulverized low-grade coal with an oil to form a slurry; heating the slurry to or above the boiling point of water to vaporize the water contained in the low-grade coal and dehydrate the coal; compressing a vapor mixture of the steam resulting from the slurry heating and that part of the oil which has vaporized simultaneously and thereby elevating the temperature and pressure of the vapor mixture; and supplying the vapor mixture increased in temperature and pressure by the compression and utilizing this vapor mixture as a high-temperature heat source to heat the slurry. In the method, the vapor mixture before being compressed is brought into contact with an oil in a liquid state. This method is a process in which low-grade coal containing water in a large proportion and hence having a low calorific value is dewatered in an oil to thereby upgrade the coal to a high-calorie fuel for thermal power generation, wherein the vapor mixture to be supplied to a compressor can be purified.

5 Claims, 3 Drawing Sheets

(56) References Cited

FOREIGN PATENT DOCUMENTS

| | | | |
|---|---|---|---|
| JP | 53 112902 | | 10/1978 |
| JP | 2776278 | B2 | 5/1998 |
| JP | 2005-131600 | | 5/2005 |
| JP | 2005 206695 | | 8/2005 |
| JP | 2007 167764 | | 7/2007 |
| JP | 2007-222812 | | 9/2007 |

OTHER PUBLICATIONS

Office Action issued on Mar. 15, 2013 in the corresponding German Patent Application No. 2009 001 305.8 (with English Translation).

Combined Office Action and Search Report issued Jan. 15, 2013 in Chinese Patent Application No. 200980116786.0 with English language translation and English translation of categories of cited documents.

* cited by examiner

METHOD AND APPARATUS FOR UPGRADING COAL

TECHNICAL FIELD

The present invention relates to a process for upgrading low-grade coal having high water content and thus low heating value into a fuel for thermal power generation having higher heating value by dehydrating it in an oil, the process being capable of purification of a vapor mixture fed to a compressor, and to a upgrading apparatus using this process.

BACKGROUND OF THE INVENTION

Patent document 1 discloses a solid fuel using porous carbon as a raw material and a process for producing the same. As shown in FIG. 3, an oil mixture containing heavy oil and solvent oil is mixed with pulverized porous carbon containing water within its pores to form a slurry, which is preheated and then fed into a tank 11. The slurry is withdrawn from the bottom of the tank 11, fed to a heat exchanger 13 by a first pump 12, and heated with a compressed vapor mixture from the compressor 14 to evaporate water within the pores of the porous carbon and a part of the oils. The heated slurry and the vapor mixture comprising water vapor and oil vapor is returned to the tank 11, wherein the slurry gathers near the bottom of the tank 11, while the vapor mixture gathers near the top. The vapor mixture is withdrawn from an upper part of the tank 11 and compressed by the compressor 14 to be increased in temperature and pressure. The vapor mixture in which temperature and pressure are increased gives heat to the slurry in the heat exchanger 13 and is condensed to water and oil. The condensate containing a mixture of water and oil is transferred to an oil/water separator 15 and separated into water and oil. The water is retained in a water storage tank 16 and discharged as wastewater from the water storage tank 16. The oil is retained in an oil storage tank 17, and is pumped out by a second pump 18 from the oil storage tank 17 to be led to external recycled oil supply equipment. In the solid fuel of patent document 1, heavy oil is deposited at places within the pores of the porous carbon where water has been, whereby prevention of spontaneous ignition of the porous carbon and increased calories as a whole are realized. In addition, the vapor mixture produced by vaporizing a part of the water and oil mixture within the pores of the porous carbon in the heating process of the slurry in the process for producing the same is heated and pressured by the compressor 14 for use as a heat source.

However, the invention disclosed in patent document 1 has the following problems: by heating a slurry comprising low-grade coal containing water and an oil mixture to or above the boiling point of water within the heat exchanger 13, the water in the low-grade coal is released as water vapor in the slurry. The water vapor generated at this time is in the form of very minute bubbles, which gives foamability to the slurry. When the slurry foams, a foam phase expands, which fills a space in an upper part of the tank 11 and may also fill the inside of the pipe leading to the compressor 14 and may be sucked by the compressor 14. Originally, the compressor 14 should be provided only with the vapor mixture, that is, a gas, but the expansion of the foam phase causes not only droplets constituting the foams but also minute coal particles to be provided together to the compressor 14. As a result, there arises the problem that not only the performance of the compressor 14 is compromised, but also failures of the compressor 14 are caused. Therefore, there has been an object of suppressing the foaming produced in the dehydration process and preventing feeding of the foam phase to compressor 14, but no specific disclosure has been made on a means for cleaning the vapor mixture.

Such bubbles have been conventionally and generally coped with by allowing them to settle naturally, but there have been the problems that a process loss is caused since the settlement of bubbles takes time and that installing a large tank for settling bubbles is costly.

Patent document 2 discloses a process for mechanically separating bubbles and liquids by using a centrifugal force as a process for preventing foaming, but it is not realistic since a huge machine is required in the case of an increased throughput.

Patent document 3 discloses a process for suppressing foaming by adding a defoamant. The process has been suggested and commercialized in various forms depending on the nature of foaming and materials, but using a large amount of expensive defoamants for fuels with low added values such as coal is economically unviable.

PRIOR ART DOCUMENT

Patent documents

Patent document 1 Japanese Patent No. 2776278

Patent document 2 JP-A No. 2005-131600

Patent document 3 JP-A No. 2007-222812

SUMMARY OF THE INVENTION

Problems to be Solved by the Invention

It is an object of the present invention to provide a process for upgrading low-grade coal having high water content and thus low heating value into a fuel for thermal power generation having higher heating value by dehydrating the coal in an oil, the process being capable of purification of a vapor mixture fed to a compressor.

Means for Solving the Problem

As a means for solving the problem, the process for upgrading coal of the present invention comprises pulverizing low-grade coal, mixing the pulverized low-grade coal with an oil to form a slurry, heating the slurry to or above the boiling point of water so that the water contained in the low-grade coal is evaporated and the slurry is dewatered, compressing a vapor mixture comprising water vapor produced by heating the slurry and a part of the oil vaporized at the same time to elevate the temperature and pressure of the vapor mixture, and using the vapor mixture in which temperature and pressure are increased by the compression as a high-temperature heat source for heating the slurry, the vapor mixture before being compressed being brought into contact with the oil in the liquid state.

By heating the slurry formed by mixing the pulverized low-grade coal with the oil to or above the boiling point of water, the water contained in the low-grade coal is evaporated and the slurry is dewatered. The vapor mixture before being compressed comprising the water vapor produced by heating the slurry and a part of the oil vaporized at the same time is brought into contact with the oil in the liquid state. This promotes the coalescence of bubbles in the vapor mixture and the growth thereof, so that the gaseous phases can be separated from the liquid phases, and the vapor mixture can be defoamed.

In addition, the apparatus for upgrading coal of the present invention comprises a tank for retaining a slurry produced by mixing pulverized low-grade coal and an oil, a heat exchanger which exchanges between the slurry fed from the tank and a high-temperature heat source, and a compressor which compresses a vapor mixture comprising water vapor produced by heat exchange with the heat exchanger and a part of the oil vaporized at the same time, the vapor mixture in which temperature and pressure are increased by the compressor being fed to the heat exchanger as a high-temperature heat source, and a defoaming tank being provided between the tank and the compressor for bringing the vapor mixture before being compressed into contact with the oil in the liquid state thereinside.

The vapor mixture is produced by feeding the preheated slurry to the tank, feeding the slurry in the tank to the heat exchanger, and heating the slurry by heat exchange with a heat exchanger. By bringing the vapor mixture into contact with the oil before it is fed to the compressor in the defoaming tank, coalescence of the bubbles in the vapor mixture and the growth of the same can be promoted. As a result, the gaseous phases can be separated from the liquid phases, and the vapor mixture can be defoamed.

More specifically, the defoaming tank preferably comprises an inlet which is connected to the tank and through which the vapor mixture flows in, an oil feed inlet which sprays the oil onto the vapor mixture flowing through the inlet, an outlet which is connected to a suction port of the compressor for discharging the vapor mixture, a mist separator provided at the outlet for removing mist of the vapor mixture, and a drain outlet for discharging a liquid mixture comprising the oil and water produced by condensation of a part of water vapor of the vapor mixture. This constitution allows the vapor mixture from the tank to flow through the inlet and brought into contact with the oil by spraying, so that coalescence of the bubbles in the vapor mixture and the growth of the bubbles can be promoted. As a result, the gaseous phases can be separated from the liquid phases, and the vapor mixture can be defoamed. In addition, mist can be removed from the vapor mixture by passing the defoamed vapor mixture through the mist separator provided at the outlet. Also, the liquid mixture sprayed from the oil feed inlet and retained in the defoaming tank can be discharged from the drain outlet.

It is preferable that an oil/water separator is provided for separating the liquid mixture of water condensed by heat exchange between the vapor mixture and the slurry with the heat exchanger and the oil into water and oil. This constitution allows the liquid mixture of the water condensed by heat exchange with the heat exchanger and the oil to be separated into water and oil.

It is preferable to feed the liquid mixture discharged from the drain outlet to the oil/water separator. This allows the liquid mixture of water and oil discharged from the drain outlet to be fed to the oil/water separator and separated into water and oil.

It is preferable to feed the part of the oil separated by the oil/water separator to the defoaming tank. This allows a part of the oil separated by the oil/water separator to be fed to the defoaming tank.

Effects of the Invention

In a process for upgrading low-grade coal having high water content and thus low heating value into a fuel for thermal power generation having higher heating value by dehydrating the coal in an oil, the vapor mixture can be purified by separating the gaseous phases of the vapor mixture fed to the compressor from its liquid phases.

DESCRIPTION OF NOTATIONS

Figure 1:
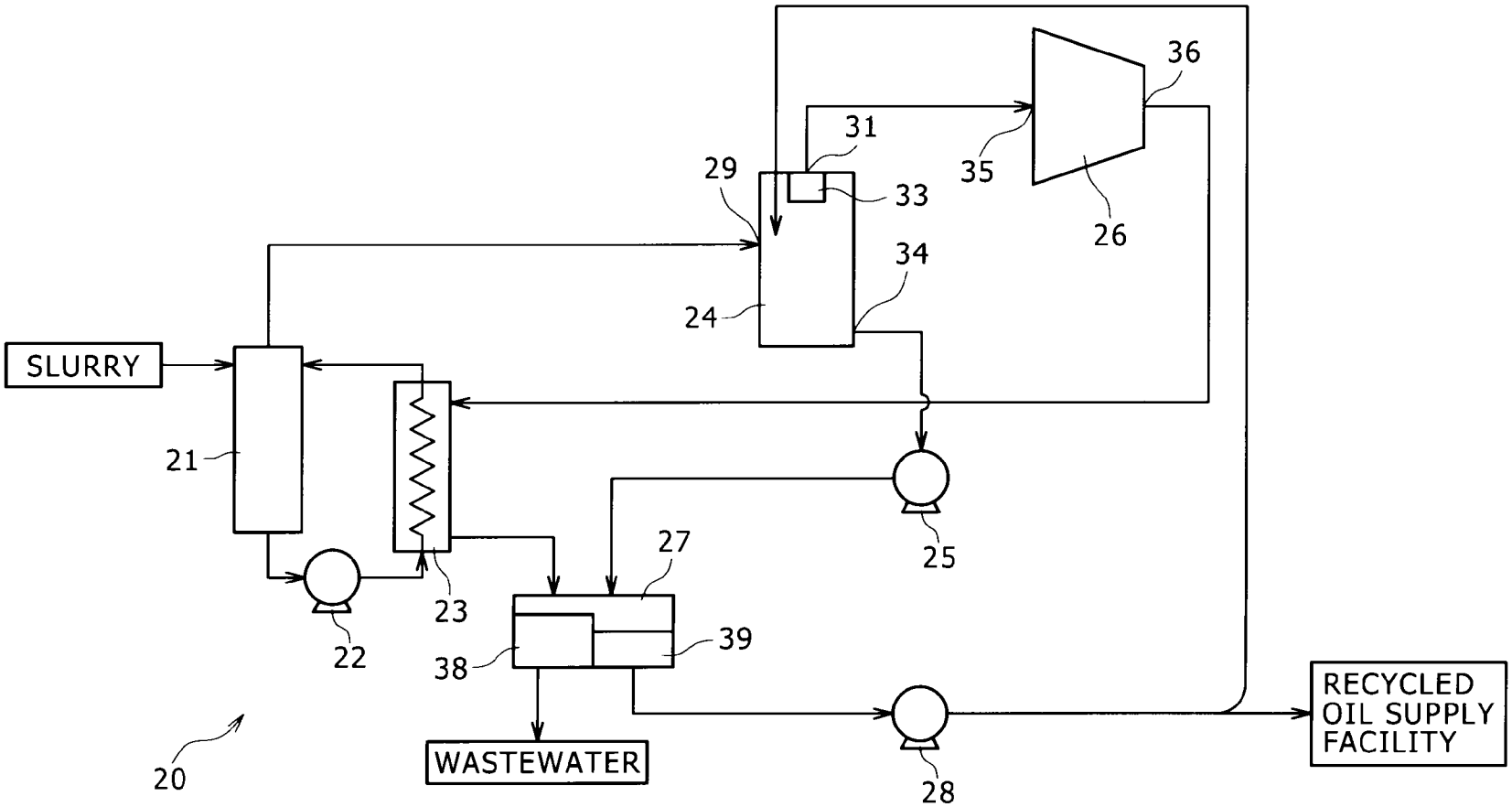
FIG. 1 is a schematic diagram of an apparatus for use in the process for upgrading coal according to the present invention.

20 Apparatus
21 Tank
22 Third pump
23 Heat exchanger
24 Defoaming tank
25 Fourth pump
26 Compressor
27 Oil/water separator
28 Fifth pump
29 Inlet
Oil feed inlet
31 Outlet
33 Mist separator
34 Drain outlet
35 Suction port
36 Discharge opening
38 Tank
39 Tank

MODE FOR CARRYING OUT THE INVENTION

Embodiments of the invention will be described below with reference to the drawings.

FIG. 1 schematically shows an apparatus 20 for use in the process for upgrading coal according to the present invention. The apparatus 20 comprises a tank 21, a third pump 22, a heat exchanger 23, a defoaming tank 24, a fourth pump 25, a compressor 26, an oil/water separator 27 and a fifth pump 28.

The tank 21 retains the slurry comprising pulverized low-grade coal containing water and an oil. The bottom of the tank 21 and the third pump 22 are in communication by means of piping. The third pump 22 and the inside the pipe of the heat exchanger 23 are in communication by means of piping. The heat exchanger 23 is so designed that giving and receiving heat between the slurry inside the pipe and the compressed gas from the compressor 26 outside the pipe can be efficiently performed. The outlet of the heat exchanger 23 and an upper portion of the tank 21 are in communication by means of piping. The top of the tank 21 and the inlet 29 of the defoaming tank 24 are in communication by means of piping.

Figure 2:
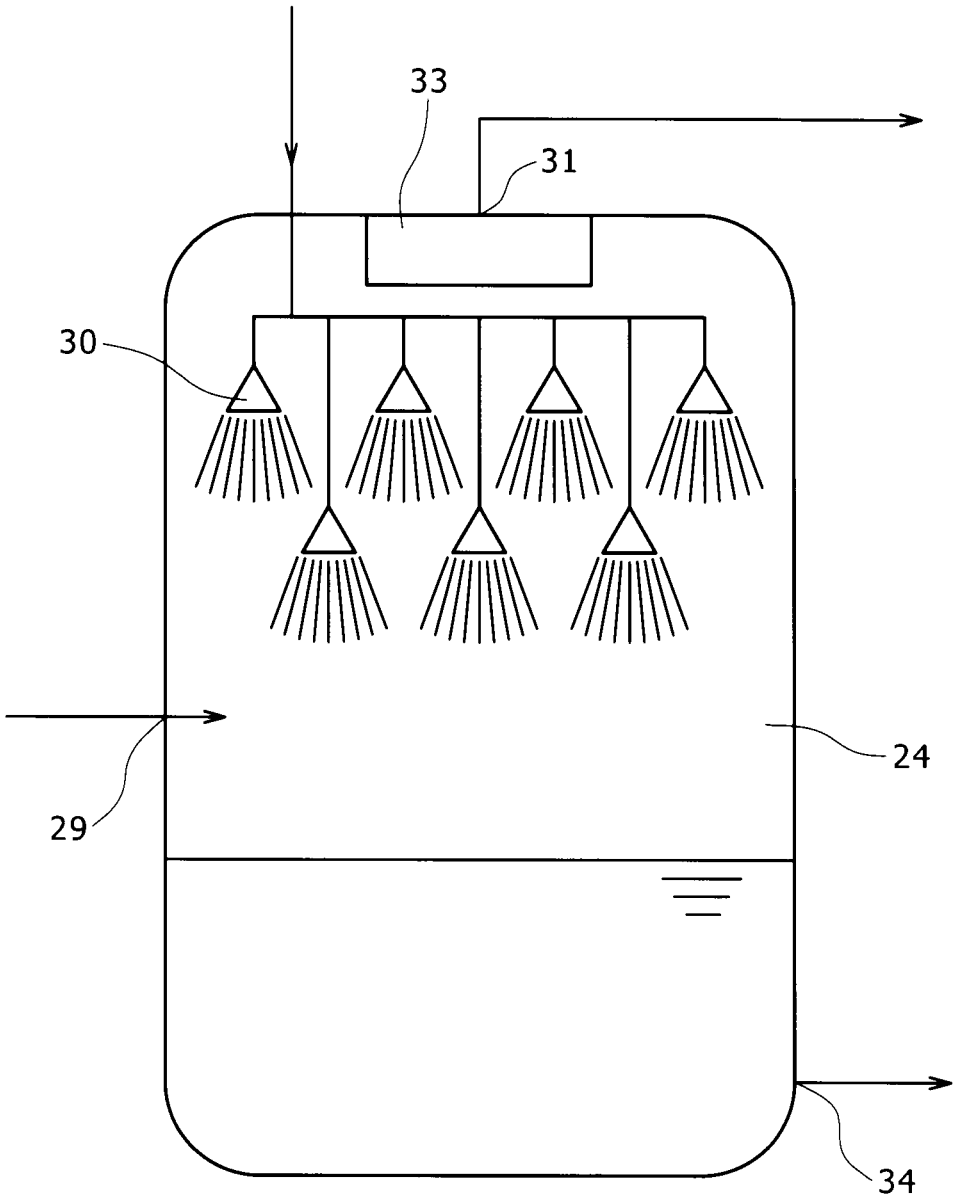
FIG. 2 is a drawing for showing the inside of the defoaming tank which provides oil by spraying from the oil feed inlet.
Figure 3:
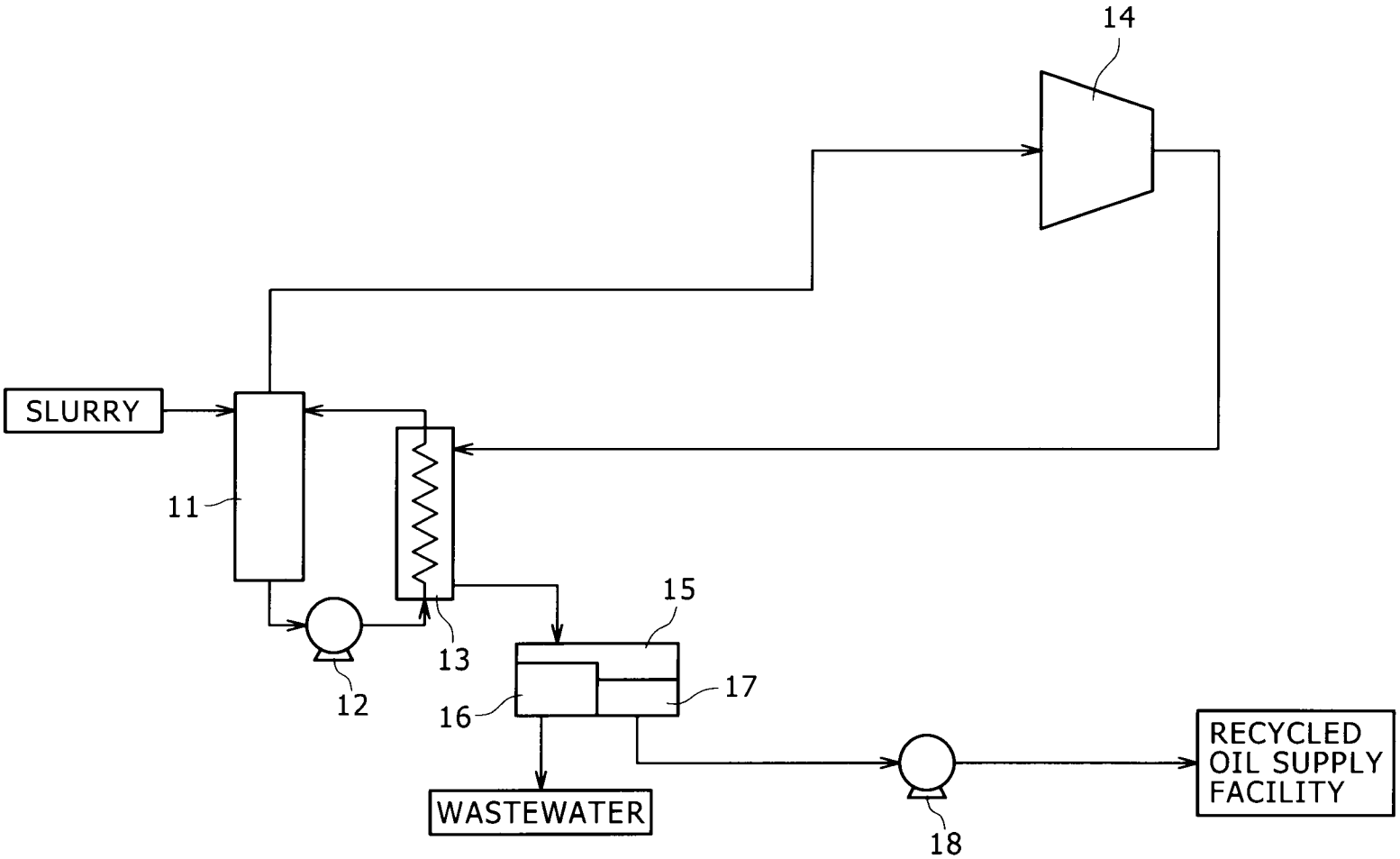
FIG. 3 is a schematic diagram of an apparatus for use in a conventional process for upgrading coal.

As shown in FIGS. 1 and 2, the inlet 29 is provided on the side face of the defoaming tank 24. A plurality of oil feed inlets 30 for providing oil by spraying is provided inside the defoaming tank 24. The outlet of the fifth pump 28 and the oil feed inlet 30 are in communication by means of piping. An outlet 31 through which the vapor mixture to be fed to the compressor 26 is discharged is provided above the defoaming tank 24. A mist separator 33 is provided at the outlet 31 of the defoaming tank 24. A drain outlet 34 is provided below the defoaming tank 24.

The drain outlet 34 and the fourth pump 25 are in communication by means of piping. The outlet 31 of the defoaming tank 24 and a suction port 35 of the compressor 26 are in communication by means of piping. The compressor 26 is provided with the suction port 35 and a discharge opening 36. The discharge opening 36 of the compressor 26 and the inlet of the heat exchanger 23 outside the pipe are in communication by means of piping. The outlet of the heat exchanger 23 outside the pipe and the fourth pump 25 are connected to the top of the oil/water separator 27, respectively, by means of piping. The oil/water separator 27 has such a structure that separates water and oil, and comprises a tank 38 for retaining separated water thereinside and a tank 39 for retaining separated oil. The bottom of the water storage tank 38 leads to an external drainage facility. The bottom of the oil storage tank 39 and the fifth pump 28 are in communication by means of piping. The outlet of the fifth pump 28 leads to external recycled oil supply equipment, and is connected to the oil feed inlet 30 of the defoaming tank 24 by means of piping.

Next, the process for upgrading coal of the present invention using the apparatus 20 having the above-mentioned constitution will be described with reference to FIG. 1. The slurry comprising pulverized low-grade coal containing water and oil is preheated, and then fed to the tank 21. Herein, the term low-grade coal means coal having relatively low heating value per unit mass, such as subbituminous coal, brown coal, lignite and peat. The term slurry means a suspension prepared by dispersing minute solids in a liquid, and is generally a name for a mixture having such a fluidity that can be generally transferred by a pump. The slurry is withdrawn from the bottom of the tank 21, fed to the heat exchanger 23 by the third pump 22, and heated with the compressed vapor mixture from the compressor 26 described later, whereby the water in the low-grade coal is evaporated. At this time, the oil is partially evaporated. The heated slurry and the vapor mixture comprising water vapor and oil vapor are returned to the tank 21. The slurry gathers near the bottom of the tank 21, while the vapor mixture gathers near the top of the tank 21. The vapor mixture is withdrawn from an upper part of the tank 21 and fed to the defoaming tank 24. The vapor mixture fed to the defoaming tank 24 passes through the mist separator 33 so that the mist contained therein is removed. The vapor mixture with mist removed is fed to the compressor 26. The fed vapor mixture is compressed, heated and pressured by the compressor 26. The heated and pressured vapor mixture is fed to the heat exchanger 23 outside the pipe. Heat is then transferred to the slurry pumped out from the tank 21 passing through the inside of the pipe by the third pump 22 by heat exchange, and water and oil are condensed separately. The liquid mixture comprising condensed water and oil is transferred to the oil/water separator 27 by the fourth pump 25 together with the liquid mixture pumped out through the drain outlet 34 of the defoaming tank 24, and is separated into water and oil. Water is retained in the water storage tank 38 and discharged from the water storage tank 38 as wastewater. The oil is retained in the oil storage tank 39 and pumped out from the oil storage tank 39 by the fifth pump 28. This oil is used as a recycled oil. A part of the oil is also fed to the defoaming tank 24. The fed oil is sprayed from the oil feed inlet 30, and is brought into contact with the vapor mixture fed from the tank 21 to the defoaming tank 24 in the defoaming tank 24. The contact between them promotes the coalescence and growth of bubbles in the foaming vapor mixture, and therefore promotes separation of the gaseous phases and the liquid phases. As a result, the vapor mixture fed to the compressor 26 can be purified.

An example of operational conditions is shown. The amount of the vapor mixture generated by the heat exchanger 23 and fed to the compressor 26 side is 7800 kg/h of water and 4800 kg/h of oil, and 12600 kg/h in total. The pressure is 0.40 MPa, and the temperature is 150° C. Meanwhile, the flow rate of the oil fed to the defoaming tank 24 is 20000 kg/h, and its temperature is 150° C. As described above, stable operation can be realized without causing failures in the compressor 26 simply by providing the defoaming tank 24 and bringing the foamable vapor mixture into contact with the oil in the liquid state in the tank 24.

The present invention is not limited to these embodiments, and can be modified in various forms. For example, the oil may be further heated in the course of the line from the fifth pump 28 to the oil feed inlet 30 to or above the temperature of the vapor mixture flowing into the defoaming tank 24. Feeding of the oil from the oil feed inlet 30 of the defoaming tank 24 may be either continuous or intermittent. It is also possible to perform such control that when the fluid level in the defoaming tank 24 is above a certain level, the liquid mixture of water and oil is discharged from the drain outlet 34 in a lower portion thereof.

The invention claimed is:

1. A process for upgrading coal comprising:

pulverizing low-grade coal;

mixing the pulverized low-grade coal with an oil to form a slurry;

heating the slurry to or above the boiling point of water so that water contained in the low-grade coal is evaporated, the slurry is dewatered, and a vapor mixture comprising water vapor and a part of the oil vaporized is formed;

spraying a part of the oil in a liquid state to be in contact with the vapor mixture to cause coalescence and growth of bubbles in the vapor mixture to promote separation of gaseous and liquid phases of the vapor mixture;

compressing the vapor mixture after spraying the part of the oil in the liquid state to elevate the temperature and pressure of the vapor mixture; and using the vapor mixture in which temperature and pressure are increased by the compression as a high-temperature heat source for heating the slurry, wherein at least most of the part of the oil in the liquid state is composed of liquid oil.

2. The process for upgrading coal according to claim 1, wherein the part of the oil in the liquid state is oil that is separated from water in a liquid mixture including the oil in the liquid state.

3. The process for upgrading coal according to claim 1, further comprising removing a mist of the vapor mixture at least after spraying the part of the oil in the liquid state and before compressing the vapor mixture.

4. The process for upgrading coal according to claim 1, further comprising:

condensing the vapor mixture into a liquid mixture including condensed water and condensed oil after using the vapor mixture as the high-temperature heat source; and separating the condensed oil from the condensed water into at least a portion of the part of the oil in the liquid state.

5. The process for upgrading coal according to claim 1, further comprising:

pumping a liquid mixture formed by the vapor mixture and the part of the oil in the liquid state to a separator; and separating in the separator the liquid mixture into water and at least a portion of the oil in the liquid state.

* * * * *